US008907855B2

(12) United States Patent
Chang

(10) Patent No.: US 8,907,855 B2
(45) Date of Patent: Dec. 9, 2014

(54) METAL FRAME ANTENNA FOR A DISPLAY

(71) Applicant: Auden Techno.Corp., Taoyuan Hsien (TW)

(72) Inventor: Ching-Wei Chang, Taoyuan Hsien (TW)

(73) Assignee: Auden Techno Corp., Taoyuan, Hsien (TW)

( * ) Notice: Subject to any disclaimer, the term of this patent is extended or adjusted under 35 U.S.C. 154(b) by 187 days.

(21) Appl. No.: 13/751,659

(22) Filed: Jan. 28, 2013

(65) Prior Publication Data

US 2014/0097997 A1 Apr. 10, 2014

(30) Foreign Application Priority Data

Oct. 8, 2012 (TW) ..... 101219453 A

(51) Int. Cl.

| | |
|---|---|
| ***H01Q 1/24*** | (2006.01) |
| ***H01Q 1/38*** | (2006.01) |
| ***H01Q 1/22*** | (2006.01) |
| ***H01Q 1/48*** | (2006.01) |
| ***H01Q 5/00*** | (2006.01) |
| ***H01Q 9/42*** | (2006.01) |
| *H01Q 21/28* | (2006.01) |

(52) U.S. Cl.

CPC . *H01Q 1/22* (2013.01); *H01Q 1/48* (2013.01); *H01Q 5/0058* (2013.01); *H01Q 9/42* (2013.01); *H01Q 1/2266* (2013.01); *H01Q 21/28* (2013.01)

USPC ..... 343/702; 343/700 MS; 343/846

(58) Field of Classification Search

USPC ..... 343/700 MS, 702, 846, 848

See application file for complete search history.

(56) References Cited

U.S. PATENT DOCUMENTS

| | | | | |
|---|---|---|---|---|
| 7,446,717 | B2 * | 11/2008 | Hung et al. | 343/702 |
| 7,659,852 | B2 * | 2/2010 | Hung et al. | 343/700 MS |
| 7,746,288 | B2 * | 6/2010 | Wang et al. | 343/846 |
| 7,821,459 | B2 * | 10/2010 | Su et al. | 343/700 MS |
| 7,839,337 | B2 * | 11/2010 | Hung et al. | 343/700 MS |
| 7,893,877 | B2 * | 2/2011 | Wang et al. | 343/700 MS |
| 7,932,861 | B2 * | 4/2011 | Hung et al. | 343/700 MS |
| 8,035,566 | B2 * | 10/2011 | Tsai et al. | 343/702 |

FOREIGN PATENT DOCUMENTS

| | | |
|---|---|---|
| TW | I369024 | 7/2012 |
| TW | I370585 | 8/2012 |

* cited by examiner

*Primary Examiner* — Tan Ho

(74) *Attorney, Agent, or Firm* — Muncy, Geissler, Olds & Lowe, P.C.

(57) ABSTRACT

A metal frame antenna includes a grounding part, a first antenna, and a second antenna. The metal frame antenna is assembled in a side of a display panel. The display panel is assembled with a metal backplane through the metal frame antenna. The assembly of a display having the metal frame antenna is easier. The volume of the display having the metal frame antenna is reduced. Moreover, the metal frame antenna having the first antenna and the second antenna is used as a multi-frequency antenna. The metal backplane is used for grounding. Therefore, the transmission efficiency of the metal frame antenna is better.

16 Claims, 7 Drawing Sheets

METAL FRAME ANTENNA FOR A DISPLAY

This application is based on and claims the benefit of Taiwan Application No. 101219453 filed Oct. 8, 2012 the entire disclosure of which is incorporated by reference herein.

BACKGROUND OF THE INVENTION

1. Field of the Invention

The present invention relates to an antenna, and especially relates to a metal frame antenna for a display panel, wherein the metal frame antenna is fixedly connected to the display panel.

2. Description of the Related Art

The electronic technology is progressing every day. Many electronic communication devices are applied for 3G, wireless local area network (WLAN), worldwide interoperability for microwave access (WiMAX), and Bluetooth, and so on. Therefore, many different frequency bands are used. Multi-frequency (broadband) antennas arranged in the electronic communication devices are developed for the different frequency bands.

The multi-frequency antenna of the related art (for examples, as shown in Taiwan patent numbers I370585 and I369024) is arranged (hided) in a frame of a housing of a liquid crystal display of a notebook. A transmission line is connected between a signal feed-in contact and a circuit board of a host computer after the multi-frequency antenna is arranged. A wireless signal received by the multi-frequency antenna is sent from the multi-frequency antenna to the circuit board through the transmission line. A signal which is processed by the circuit board and is designed to wirelessly send out is sent from the circuit board to the multi-frequency antenna to wirelessly send out.

The length of the multi-frequency antenna should be long enough for different frequency bands, but the length of the multi-frequency antenna should be short enough as well for being arranged in the frame of the liquid crystal display. Therefore, radiators of the multi-frequency antenna are usually designed in a meandering shape. The volume of the multi-frequency antenna is large. Therefore, the space of the frame of the liquid crystal display is widened, so that the multi-frequency antenna can be arranged in the frame of the liquid crystal display. The design trend of the modern electronic devices should be slim and light, but the design mentioned above is not slim and light.

SUMMARY OF THE INVENTION

In order to solve the above-mentioned problems, an object of the present invention is to provide a metal frame antenna. The metal frame antenna is fixedly connected to a side of a display panel. The assembly of a display having the metal frame antenna is easier. The volume of the display having the metal frame antenna is reduced.

The metal frame antenna is fixedly screwed to a metal backplane of the display after the metal frame antenna is assembled with the display panel. The metal backplane is used for grounding. Therefore, the transmission efficiency of the metal frame antenna is better.

In order to achieve the object of the present invention mentioned above, the metal frame antenna is assembled with the display panel. The display panel is assembled with the metal backplane. The metal frame antenna includes a grounding part, a first antenna, and a second antenna. The grounding part includes two convex parts. One of the convex parts is at an end of the grounding part. The other convex part is at the other end of the grounding part. Each of the convex parts includes a via hole for fixedly connecting to the metal backplane. The first antenna includes a first radiator parallel to the grounding part. The first radiator includes a first connection part electrically connected to the grounding part. The first connection part includes a first extension part and a second extension part connected to the first radiator. The second antenna includes a second radiator parallel to the grounding part. The second radiator includes a second connection part electrically connected to the grounding part. The first extension part includes a first signal feed-in contact. The first connection part includes a second signal feed-in contact. The second extension part includes a third signal feed-in contact. The second connection part includes a fourth signal feed-in contact. The grounding part includes a plurality of through holes. Plural screws are screwed into the through holes. The grounding part is fixedly screwed into the side of the display. The screws are screwed into the via holes. The grounding part is fixedly screwed into the metal backplane. The first connection part includes a first metal segment, a second metal segment, and a third metal segment. The first metal segment is perpendicularly connected to the second metal segment. The second metal segment is perpendicularly connected to the third metal segment. The third metal segment is perpendicularly connected to the grounding part. The second signal feed-in contact is at a connection point of the first metal segment and the second metal segment. The first extension part includes a first extension segment and a second extension segment. The first extension segment is perpendicularly connected to the second extension segment. The first signal feed-in contact is at a connection point of the first extension segment and the second extension segment. The second extension part includes a third extension segment and a fourth extension segment. The third extension segment is perpendicularly connected to the fourth extension segment. The third signal feed-in contact is at a connection point of the third extension segment and the fourth extension segment. A length of the second radiator is shorter than a length of the first radiator. The second connection part includes a fourth metal segment, a fifth metal segment, and a sixth metal segment. The fourth metal segment is perpendicularly connected to the fifth metal segment. The fifth metal segment is perpendicularly connected to the sixth metal segment. The sixth metal segment is perpendicularly connected to the grounding part. The fourth signal feed-in contact is at a connection point of the fourth metal segment and the fifth metal segment. Each of the first signal feed-in contact, the second signal feed-in contact, the third signal feed-in contact, and the fourth signal feed-in contact is electrically connected to a transmission line. The transmission line is a coaxial cable.

DETAILED DESCRIPTION OF THE INVENTION

Figure 1:
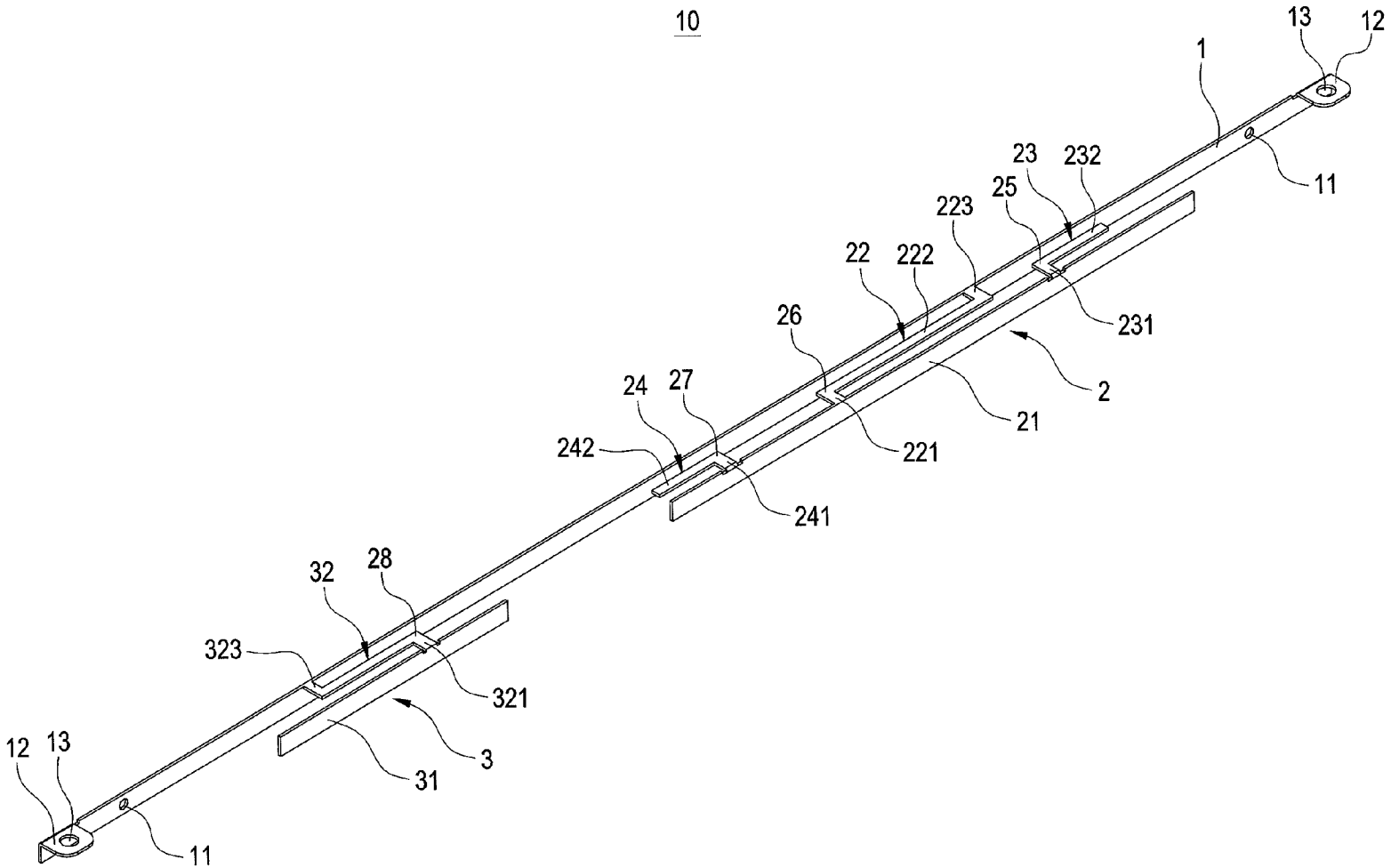
FIG. 1 shows a diagram of the metal frame antenna of the present invention.

FIG. 1 shows a diagram of the metal frame antenna of the present invention. A metal frame antenna 10 of the present invention includes a grounding part 1, a first antenna 2, and a second antenna 3.

The grounding part 1 includes a plurality of through holes 11. Plural screws (not shown in FIG. 1) are screwed into the through holes 11. The grounding part 1 is fixedly screwed into a side of a display (not shown in FIG. 1). The grounding part 1 includes two convex parts 12. One of the convex parts 12 is at an end of the grounding part 1. The other convex part 12 is at the other end of the grounding part 1. Each of the convex parts 12 includes a via hole 13. The screws are screwed into the via holes 13. The grounding part 1 is fixedly screwed into a metal backplane (not shown in FIG. 1) of the display. The grounding part 1 is strip-shaped. A length of the grounding part 1 is determined in accordance with a length of the side of the display. The display is a liquid crystal display or a plasma display.

The first antenna 2 includes a first radiator 21 parallel to the grounding part 1. The first radiator 21 includes a first connection part 22 electrically connected to the grounding part 1. The first connection part 22 includes a first metal segment 221, a second metal segment 222, and a third metal segment 223. The first metal segment 221 is perpendicularly connected to the second metal segment 222. The second metal segment 222 is perpendicularly connected to the third metal segment 223. The third metal segment 223 is perpendicularly connected to the grounding part 1. The first connection part 22 includes a first extension part 23 and a second extension part 24 connected to the first radiator 1. The first extension part 23 includes a first extension segment 231 and a second extension segment 232. The first extension segment 231 is perpendicularly connected to the second extension segment 232. The second extension part 24 includes a third extension segment 241 and a fourth extension segment 242. The third extension segment 241 is perpendicularly connected to the fourth extension segment 242. A first signal feed-in contact 25 is at a connection point of the first extension segment 231 and the second extension segment 232. A second signal feed-in contact 26 is at a connection point of the first metal segment 221 and the second metal segment 222. A third signal feed-in contact 27 is at a connection point of the third extension segment 241 and the fourth extension segment 242.

The second antenna 3 includes a second radiator 31. A length of the second radiator 31 is shorter than a length of the first radiator 21. The second radiator 31 is parallel to the grounding part 1 and is electrically connected to the grounding part 1. The second radiator 31 includes a second connection part 32. The second connection part 32 includes a fourth metal segment 321, a fifth metal segment 322, and a sixth metal segment 323. The fourth metal segment 321 is perpendicularly connected to the fifth metal segment 322. The fifth metal segment 322 is perpendicularly connected to the sixth metal segment 323. The sixth metal segment 323 is perpendicularly connected to the grounding part 1. A fourth signal feed-in contact 28 is at a connection point of the fourth metal segment 321 and the fifth metal segment 322.

Figure 2:
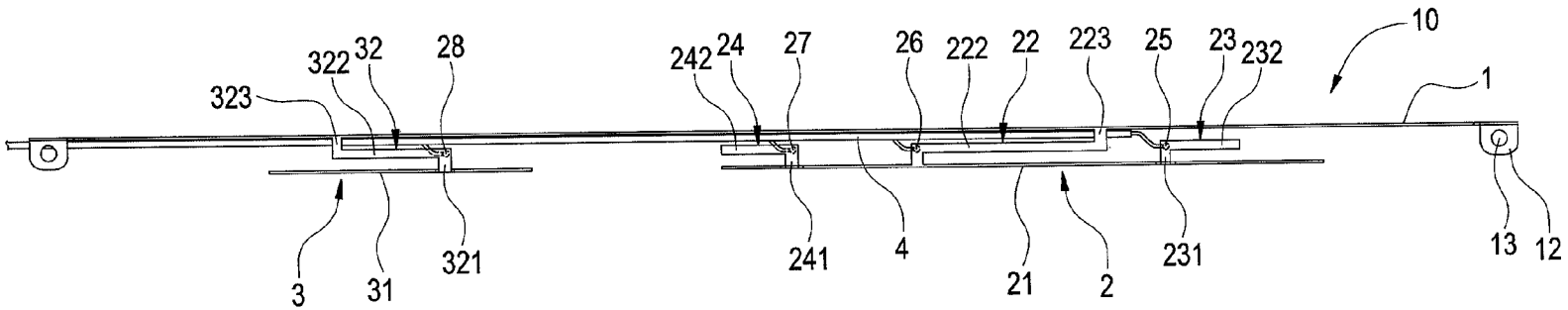
FIG. 2 shows a diagram of the metal frame antenna and the transmission line.

FIG. 2 shows a diagram of the metal frame antenna and the transmission line. Each of the first signal feed-in contact 25, the second signal feed-in contact 26, the third signal feed-in contact 27, and the fourth signal feed-in contact 28 is electrically connected to a transmission line 4 after the metal frame antenna 10 has been manufactured. The transmission line 4 is a coaxial cable.

Example 1

The first antenna 2 is configured to supply wireless local area network (WLAN), worldwide interoperability for microwave access (WiMAX), and Bluetooth functions when single of the transmission line 4 is connected to the first signal feed-in contact 25.

Example 2

The first antenna 2 is configured to supply the Penta-Band antenna (for example, 3G antenna) function when one of the transmission line 4 is connected to the second signal feed-in contact 26. The first antenna 2 and the second antenna 3 are configured to supply wireless local area network (WLAN), worldwide interoperability for microwave access (WiMAX), and Bluetooth functions when another transmission line 4 is connected to the fourth signal feed-in contact 28 in the same time.

Example 3

The first antenna 2 is configured to supply Penta-Band antenna (for example, 3G antenna) function when one of the transmission line 4 is connected to the third signal feed-in contact 27. The first signal feed-in contact 25 and the third signal feed-in contact 27, or the third signal feed-in contact 27 and the fourth signal feed-in contact 28 are configured to supply wireless local area network (WLAN), worldwide interoperability for microwave access (WiMAX), and Bluetooth functions when another transmission line 4 is connected to the first signal feed-in contact 25 or to the fourth signal feed-in contact 28 at the same time.

Example 4

The first antenna 2 is configured to supply wireless local area network (WLAN), worldwide interoperability for microwave access (WiMAX), and Bluetooth functions when single of the transmission line 4 is connected to the fourth signal feed-in contact 28.

Figure 3:
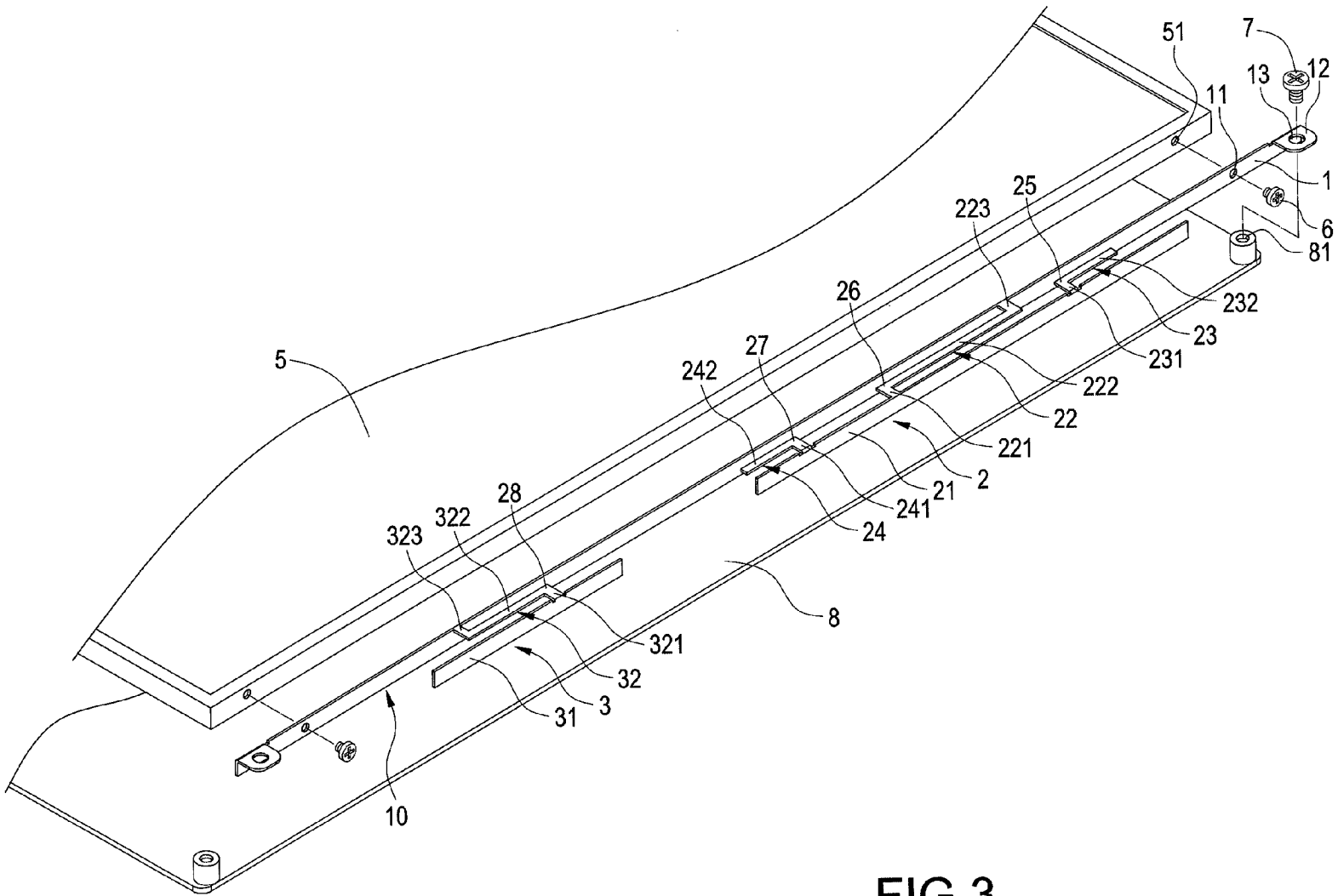
FIG. 3 shows a diagram of the metal frame antenna and the display panel.
Figure 4:
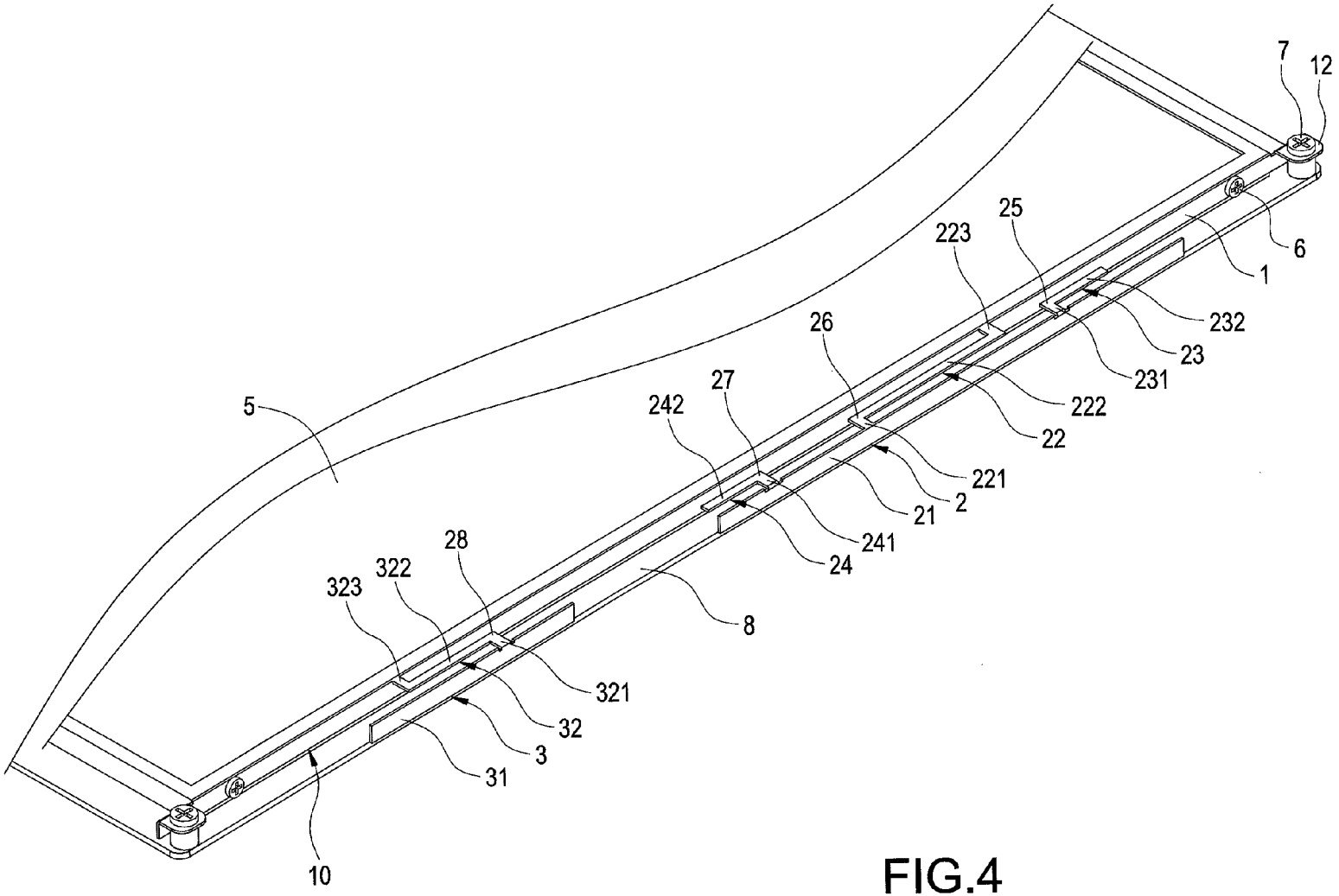
FIG. 4 shows a diagram of the combination of the metal frame antenna and the display panel.
Figure 5:
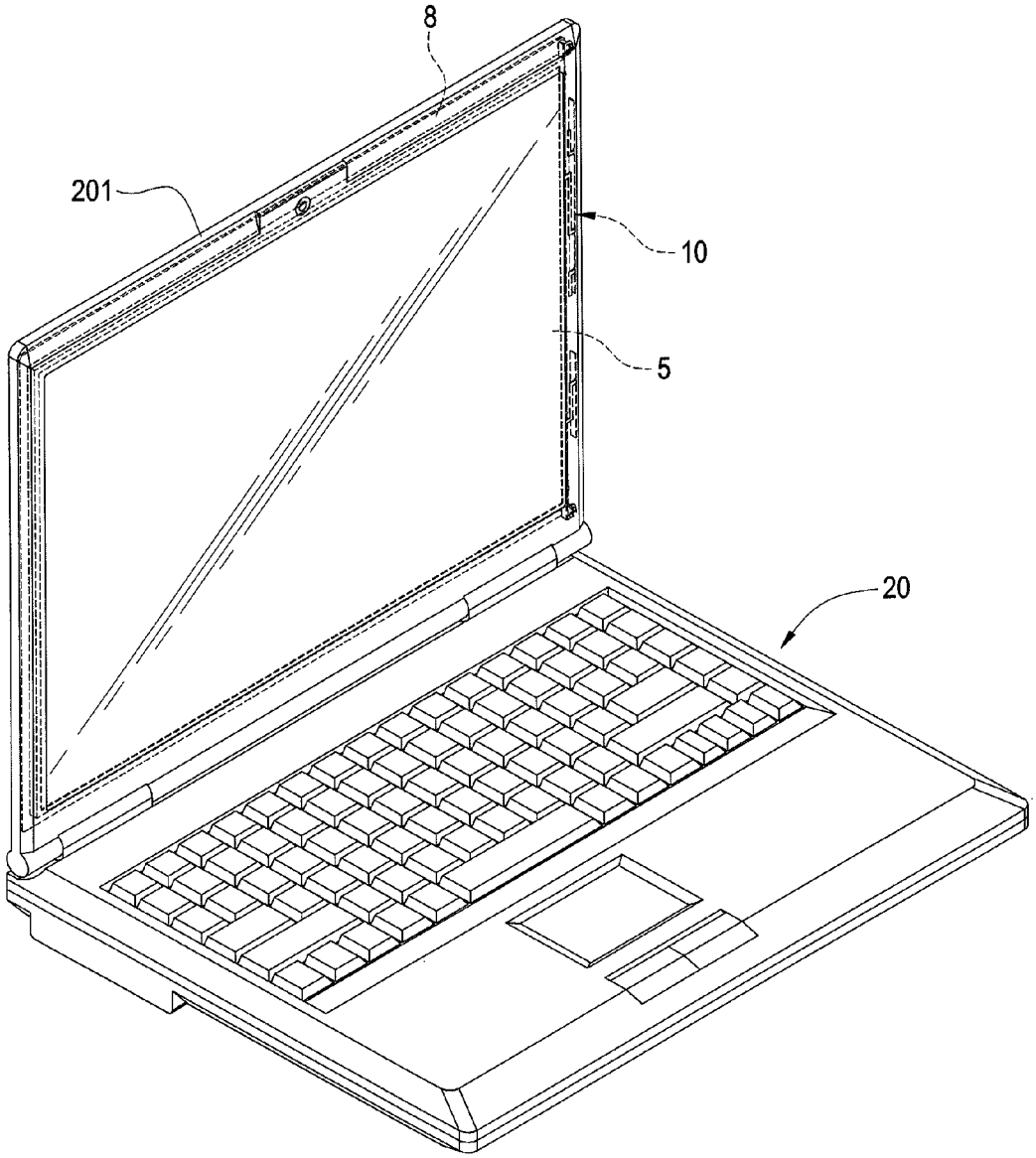
FIG. 5 shows a diagram of the assembly of the metal frame antenna, the display panel, and the computer.

FIG. 3 shows a diagram of the metal frame antenna and the display panel. FIG. 4 shows a diagram of the combination of the metal frame antenna and the display panel. FIG. 5 shows a diagram of the assembly of the metal frame antenna, the display panel, and the computer. The present invention is to take a liquid crystal display 20 as an example. The grounding part 1 of the metal frame antenna 10 is arranged in one side of a liquid crystal display panel 5 after components in each layers of the liquid crystal display panel 5 are assembled. Plural screws 6 are screwed into the through holes 11 of the grounding part 1 and the screw holes 51 of the liquid crystal display panel 5. Therefore, the metal frame antenna 10 is fixedly screwed into the side of the liquid crystal display panel 5.

Plural screws 7 are screwed into the via holes 13 of the convex parts 12 of the grounding part 1 after the liquid crystal display panel 5 and the metal frame antenna 10 are assembled. The metal frame antenna 10 is fixedly connected to the metal backplane 8. The liquid crystal display panel 5 is screwed into plural screw holes 81 of the metal backplane 8. The grounding part 1 of the metal frame antenna 10 is fixedly connected to the metal backplane 8. The metal backplane 8 is used for grounding. Therefore, the transmission efficiency of the metal frame antenna 10 is better. The assembly of the liquid crystal display 20 is easier, slim, and light. The volume of the liquid crystal display 20 is reduced.

Figure 6:
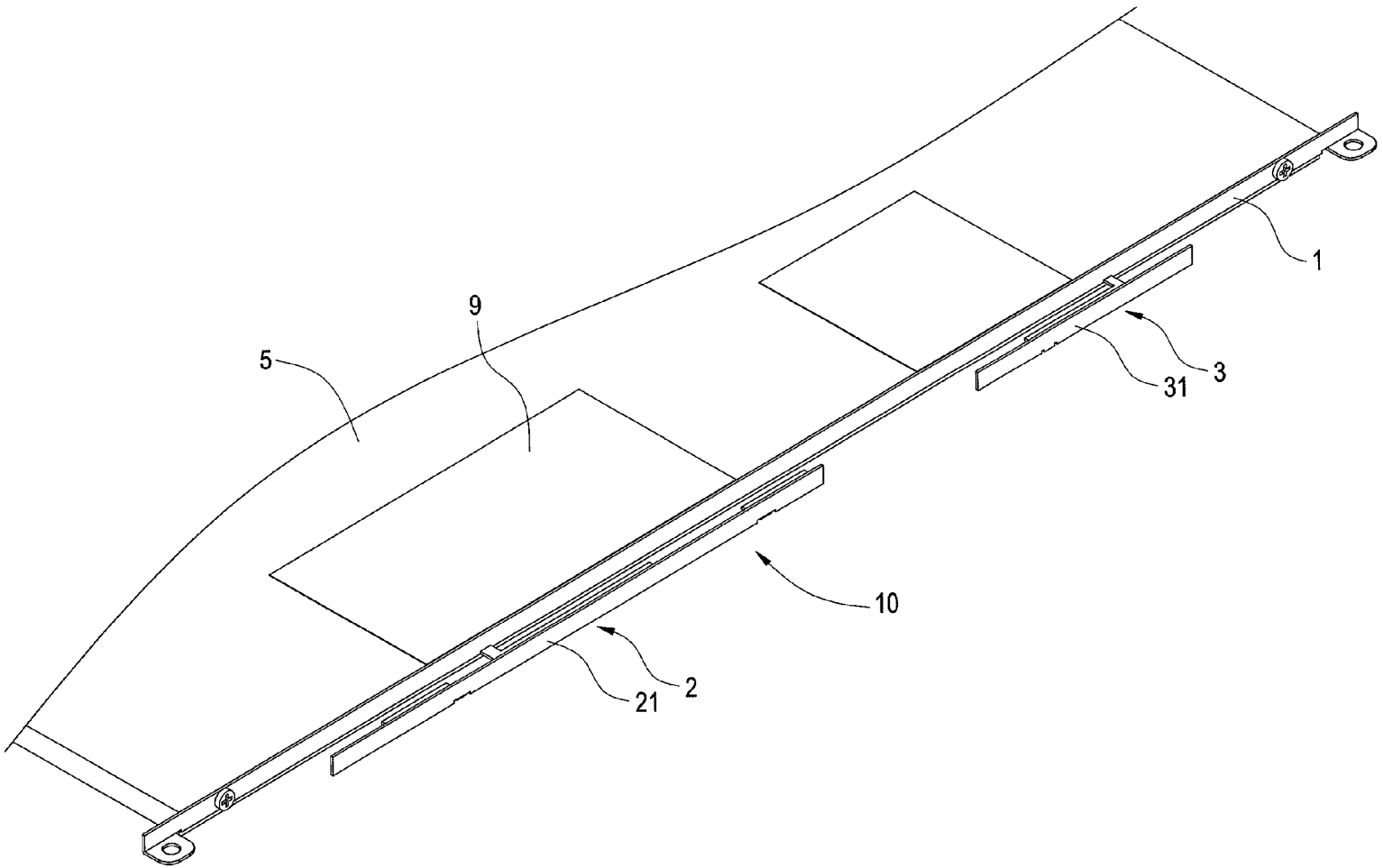
FIG. 6 shows a diagram of another embodiment of the metal frame antenna and the display panel.

FIG. 6 shows a diagram of another embodiment of the metal frame antenna and the display panel. At least a metal plate 9 is attached to a back side of the liquid crystal display panel 5 after the metal frame antenna 10 is fixedly connected to the liquid crystal display panel 5. The metal plate 9 is fixedly electrically connected to the grounding part 1 of the metal frame antenna 10. The metal plate 9 is used for grounding. Therefore, the transmission efficiency of the metal frame antenna 10 is better.

Figure 7:
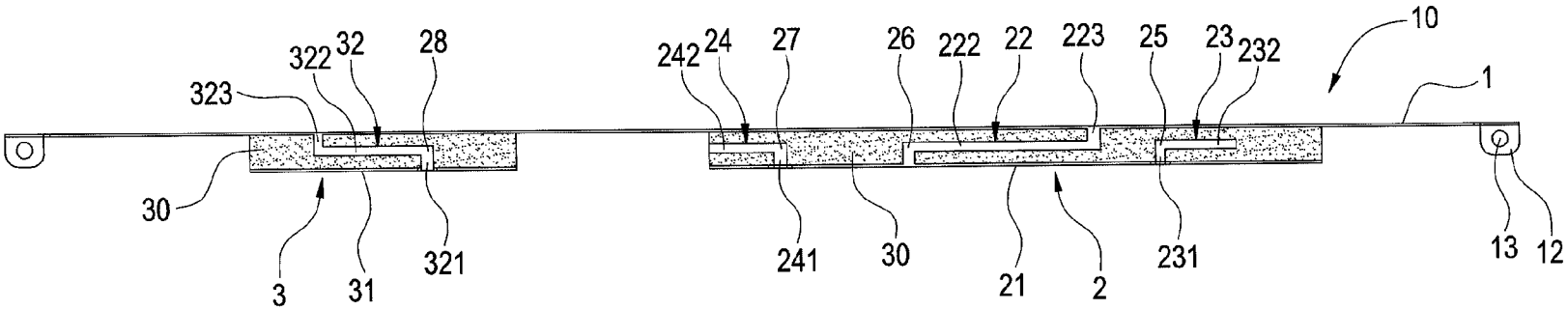
FIG. 7 shows a diagram of another embodiment of the metal frame antenna of the present invention.

FIG. 7 shows a diagram of another embodiment of the metal frame antenna of the present invention. A filling stuff 30 is arranged between the grounding part 1 and the first radiator 21 of the first antenna 2, and between the grounding part 1 and the second radiator 31 of the second antenna 3. The filling stuff 30 is adapted to prevent the first radiator 21 and the second radiator 31 from deforming. The filling stuff 30 is a foam, a sponge, or a plastic block.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A metal frame antenna assembled with a display panel, the display panel assembled with a metal backplane, the metal frame antenna including:

a grounding part including two convex parts, one of the convex parts at an end of the grounding part, the other convex part at the other end of the grounding part, each of the convex parts including a via hole for fixedly connecting to the metal backplane;

a first antenna including a first radiator parallel to the grounding part, the first radiator including a first connection part electrically connected to the grounding part, the first connection part including a first extension part and a second extension part connected to the first radiator; and a second antenna including a second radiator parallel to the grounding part, the second radiator including a second connection part electrically connected to the grounding part, wherein the first extension part includes a first signal feed-in contact; the first connection part includes a second signal feed-in contact; the second extension part includes a third signal feed-in contact; the second connection part includes a fourth signal feed-in contact.

2. The metal frame antenna in claim 1, wherein the grounding part includes a plurality of through holes; a plural of screws are screwed into the through holes; the grounding part is fixedly screwed into a side of a display.

3. The metal frame antenna in claim 2, wherein the screws are screwed into the via holes;

the grounding part is fixedly screwed into the metal backplane.

4. The metal frame antenna in claim 3, wherein the first connection part includes a first metal segment, a second metal segment, and a third metal segment; the first metal segment is perpendicularly connected to the second metal segment; the second metal segment is perpendicularly connected to the third metal segment; the third metal segment is perpendicularly connected to the grounding part.

5. The metal frame antenna in claim 4, wherein the second signal feed-in contact is at a connection point of the first metal segment and the second metal segment.

6. The metal frame antenna in claim 5, wherein the first extension part includes a first extension segment and a second extension segment; the first extension segment is perpendicularly connected to the second extension segment.

7. The metal frame antenna in claim 6, wherein the first signal feed-in contact is at a connection point of the first extension segment and the second extension segment.

8. The metal frame antenna in claim 7, wherein the second extension part includes a third extension segment and a fourth extension segment; the third extension segment is perpendicularly connected to the fourth extension segment.

9. The metal frame antenna in claim 8, wherein the third signal feed-in contact is at a connection point of the third extension segment and the fourth extension segment.

10. The metal frame antenna in claim 9, wherein a length of the second radiator is shorter than a length of the first radiator.

11. The metal frame antenna in claim 10, wherein the second connection part includes a fourth metal segment, a fifth metal segment, and a sixth metal segment; the fourth metal segment is perpendicularly connected to the fifth metal segment; the fifth metal segment is perpendicularly connected to the sixth metal segment; the sixth metal segment is perpendicularly connected to the grounding part.

12. The metal frame antenna in claim 11, wherein the fourth signal feed-in contact is at a connection point of the fourth metal segment and the fifth metal segment.

13. The metal frame antenna in claim 12, wherein each of the first signal feed-in contact, the second signal feed-in contact, the third signal feed-in contact, and the fourth signal feed-in contact is electrically connected to a transmission line.

14. The metal frame antenna in claim 13, wherein the transmission line is a coaxial cable.

15. The metal frame antenna in claim 14, further including a filling stuff arranged between the grounding part and the first radiator of the first antenna, and between the grounding part and the second radiator of the second antenna.

16. The metal frame antenna in claim 15, wherein the filling stuff is a foam, a sponge, or a plastic block.

* * * * *